US006840420B1

(12) United States Patent
Hudson

(10) Patent No.: US 6,840,420 B1
(45) Date of Patent: Jan. 11, 2005

(54) DEVICE FOR HOLDING A BADGE AND AN IDENTIFICATION CARD

(76) Inventor: Alfred R. Hudson, 515 Broadway, Malden, MA (US) 02148-2036

( * ) Notice: Subject to any disclaimer, the term of this patent is extended or adjusted under 35 U.S.C. 154(b) by 83 days.

(21) Appl. No.: 10/335,336

(22) Filed: Dec. 31, 2002

(51) Int. Cl.[7] ..... A47G 1/12

(52) U.S. Cl. ..... 224/669; 40/1.5; 40/649; 224/670; 224/674; 224/675; 224/677; 224/680

(58) Field of Search ..... 224/660, 663, 224/665, 666, 669, 670, 671, 674, 675, 677, 680; 40/1.5, 649, 651, 661.04

(56) References Cited

U.S. PATENT DOCUMENTS

| | | | | | |
|---|---|---|---|---|---|
| 551,359 | A | * | 12/1895 | Braillard | 224/660 |
| 668,466 | A | * | 2/1901 | Taylor et al. | 224/677 |
| 2,328,206 | A | * | 8/1943 | Fowler | 40/1.5 |
| 2,972,826 | A | * | 2/1961 | Newell | 40/1.5 |
| 3,657,834 | A | * | 4/1972 | Tauber | 40/1.5 |
| 3,660,915 | A | * | 5/1972 | Davis | 40/649 |
| 3,829,995 | A | * | 8/1974 | Fakoury | 40/649 |
| 3,999,317 | A | * | 12/1976 | Owens | 40/1.5 |
| 4,137,657 | A | | 2/1979 | Wardle | |
| 4,509,277 | A | * | 4/1985 | Bolton | 40/1.5 |
| 4,779,655 | A | | 10/1988 | Olson | |
| 4,821,934 | A | | 4/1989 | Alessi et al. | |
| 4,852,783 | A | * | 8/1989 | Bryden et al. | 224/674 |
| 5,584,424 | A | | 12/1996 | Stava | |
| 5,640,742 | A | | 6/1997 | White et al. | |
| 5,791,076 | A | | 8/1998 | Gailliard | |
| 5,979,019 | A | | 11/1999 | Johnson | |
| 6,035,564 | A | * | 3/2000 | Cosmo et al. | 40/661.04 |
| 6,226,905 | B1 | * | 5/2001 | Osuna | 40/661.04 |
| 6,269,993 | B1 | | 8/2001 | Ebejer et al. | |

* cited by examiner

*Primary Examiner*—Gary E. Elkins
(74) *Attorney, Agent, or Firm*—Kriegsman & Kriegsman

(57) ABSTRACT

A device for holding a badge and an identification card includes a first strip of material constructed of leather. The first strip of material is shaped to include first and second generally oval-shaped portions which are connected through a neck. The first portion is shaped to include a pair of openings through which the badge can be pinned. A second strip of material constructed of leather is sewn onto the first strip of material along three sides so as to define a generally rectangular-shaped pocket for receiving the identification card, the first strip of material being shaped to include a centered window to display the identification card when disposed within the pocket. The first strip of material can be folded about the neck to form a closed loop. A pair of complementary fasteners are mounted onto the first strip of material to retain the device in its closed loop configuration.

3 Claims, 6 Drawing Sheets

DEVICE FOR HOLDING A BADGE AND AN IDENTIFICATION CARD

BACKGROUND OF THE INVENTION

The present invention relates generally to badges and more particularly to badge holding devices.

An officer (e.g., a police officer or a corrections officer) is typically issued a badge as a means to authenticate his/her position of employment. The badge of an officer is typically manufactured of metal in an ornamental design (e.g., a star) with the title of the officer displayed thereon.

An officer often wears his/her badge in plain view in order to readily provide others with the proper identification of the position of the officer. Specifically, a fastening device is typically mounted onto the rear surface of the badge which, in turn, enables the badge to be removably mounted onto an exterior layer of the officer's clothing, such as a jacket. The fastening device is commonly in the form of an elongated sharpened pin which is pivotally mounted onto the back surface of the badge, the elongated sharpened pin being releasably retained in place by a clasp which is also mounted onto the back surface of the badge. In this capacity, the sharpened pin can be pierced through the exterior layer of clothing and retained by the clasp in order to secure the badge onto the exterior layer of clothing.

Pinning a badge onto an exterior layer of clothing has been found to be undesirable. Specifically, an officer routinely wears different articles of clothing. As a result, the badge must be repeatedly mounted onto different articles of clothing depending upon what the officer is wearing on a particular day.

As a result, devices for holding badges (also referred to herein simply as badge holders) are well known and widely used in the art. In use, an officer maintains his/her badge pinned onto a badge holder which, in turn, can be easily mounted onto the officer so as to readily display the badge for viewing.

One type of badge holder which is well known and widely used in the art comprises a closed-loop chain which can be suspended around the neck of an officer. As such, an officer can readily wear the closed-loop chain as a necklace with the badge disposed against the chest of the officer. As can be appreciated, a badge holder of this type can be easily placed around and removed from the neck of the officer, which is highly desirable;

In U.S. Pat. No. 5,791,076 there is disclosed a badge holder apparatus for displaying information pertaining to the wearer's official position, comprising a first backing member to which a badge selectively attaches; a second backing member which is connected to the first backing member; a necklace member which is operably associated with the second backing member; a first plate member which is disposed along an exposed surface of the second backing member and having information printed thereon; and wherein the first backing member and the second backing member are substantially rigid.

Although well-known and widely used in commerce, conventional badge holders typically suffer from a notable drawback. Specifically, it has been found that people, on occasion, manufacture counterfeit badges or unlawfully acquire an authentic badge. As can be appreciated, the ability of unauthorized people to represent themselves as legitimate officers poses a significant safety threat.

As a result, officers are routinely required to present an identification card in conjunction with a badge in order to more securely authenticate his/her position of employment. By cross-referencing the information imprinted onto the badge with the information listed on the identification card, an organization can more confidently authenticate whether a person is an authorized official of the organization, which is highly desirable.

Requiring an officer to provide an identification card in addition to a badge introduces a notable drawback. Specifically, the identification card of an officer is not typically presented in plain view of others. Rather, the identification card of an officer is typically stored in a pocket of the officer. As a result, when required to display an identification card, an officer must reach inside his/her pocket to withdraw the identification card, which can be considerably cumbersome, time-consuming and/or dangerous (e.g., when an officer is using both hands to restrain someone).

SUMMARY OF THE INVENTION

It is an object of the present invention to provide a new and improved device for holding a badge and an identification card.

It is another object of the present invention to provide a device as described above which can be readily worn by an officer.

It is yet another object of the present invention to provide a device as described above which displays the badge and identification in plain view of others.

It is still another object of the present invention to provide a device as described above can be mounted onto a belt.

It is yet still another object of the present invention to provide a device as described above which has a limited number of parts, which is inexpensive to manufacture and is easy to use.

Accordingly, as a feature of the present invention, there is provided a device for holding a badge and an identification card, said device comprising a first section adapted to retain the identification card, and a second section adapted to retain the badge, said second section being coupled to said first section.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 7(*b*) is a left side plan view of the fastener shown in FIG. 6.

DETAILED DESCRIPTION OF THE PREFERRED EMBODIMENT

Figure 1:
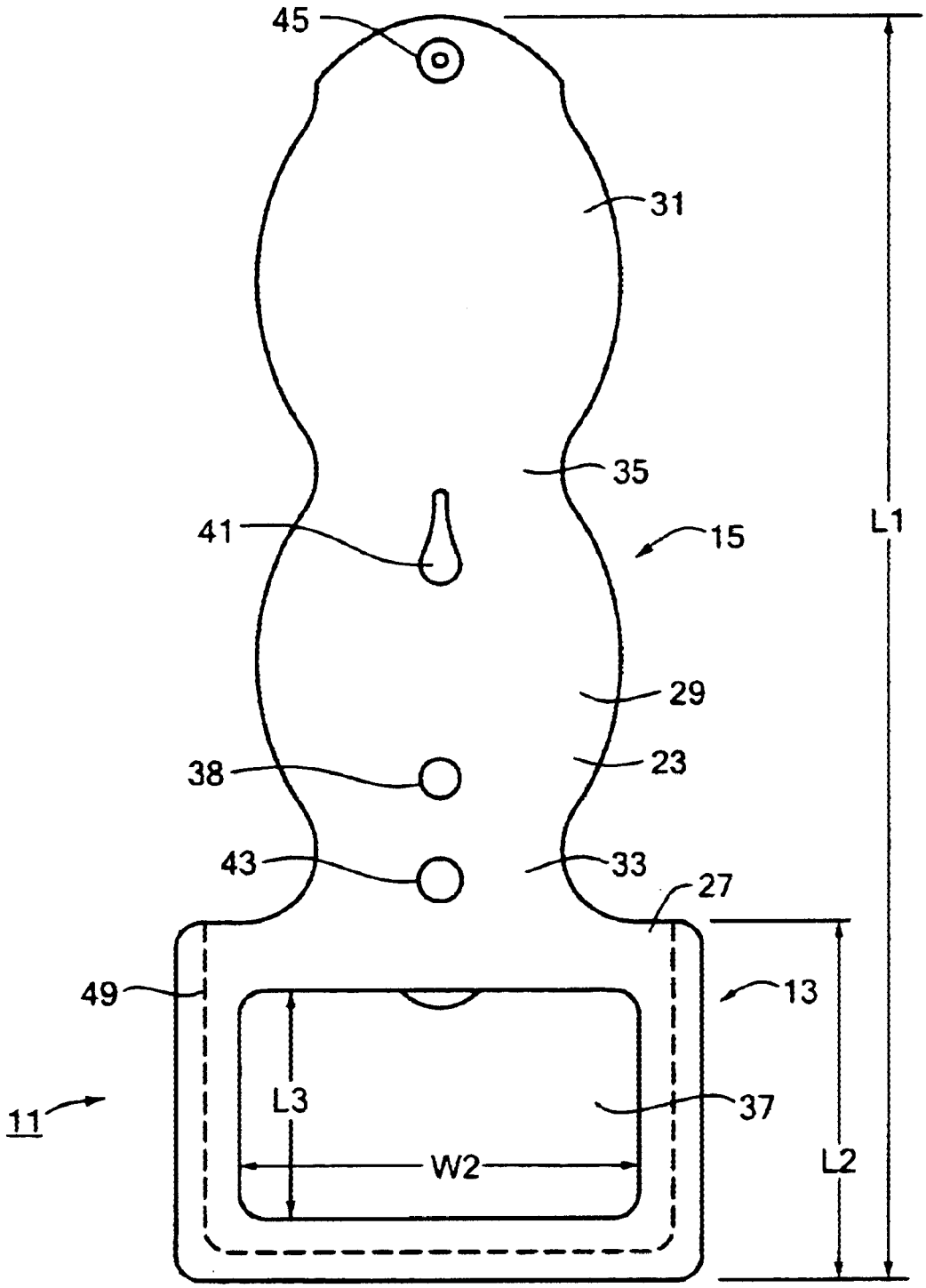
FIG. 1 is a front plan view of a first embodiment of a device for holding a badge and an identification card, said device being constructed according to the teachings of the present invention.

Referring now to FIGS. 1–5, there is shown a first embodiment of device for holding a badge and an identification card, the device being constructed according to the teachings of the present invention and identified generally by reference numeral 11.

Device 11 comprises a first section 13 and a second section 15. As seen most clearly in FIG. 3, first section 13 is adapted to retain a conventional identification (ID) card 17. Second section 15 is adapted to retain a conventional badge 19. As will be described further in detail below, second section 15 can also be releasably formed into a closed loop. In this capacity, device 11 can be easily mounted onto a belt B in such a manner so as to readily display identification card 17 and badge 19 in plain view of others, which is a principal feature of the present invention.

Figure 2:
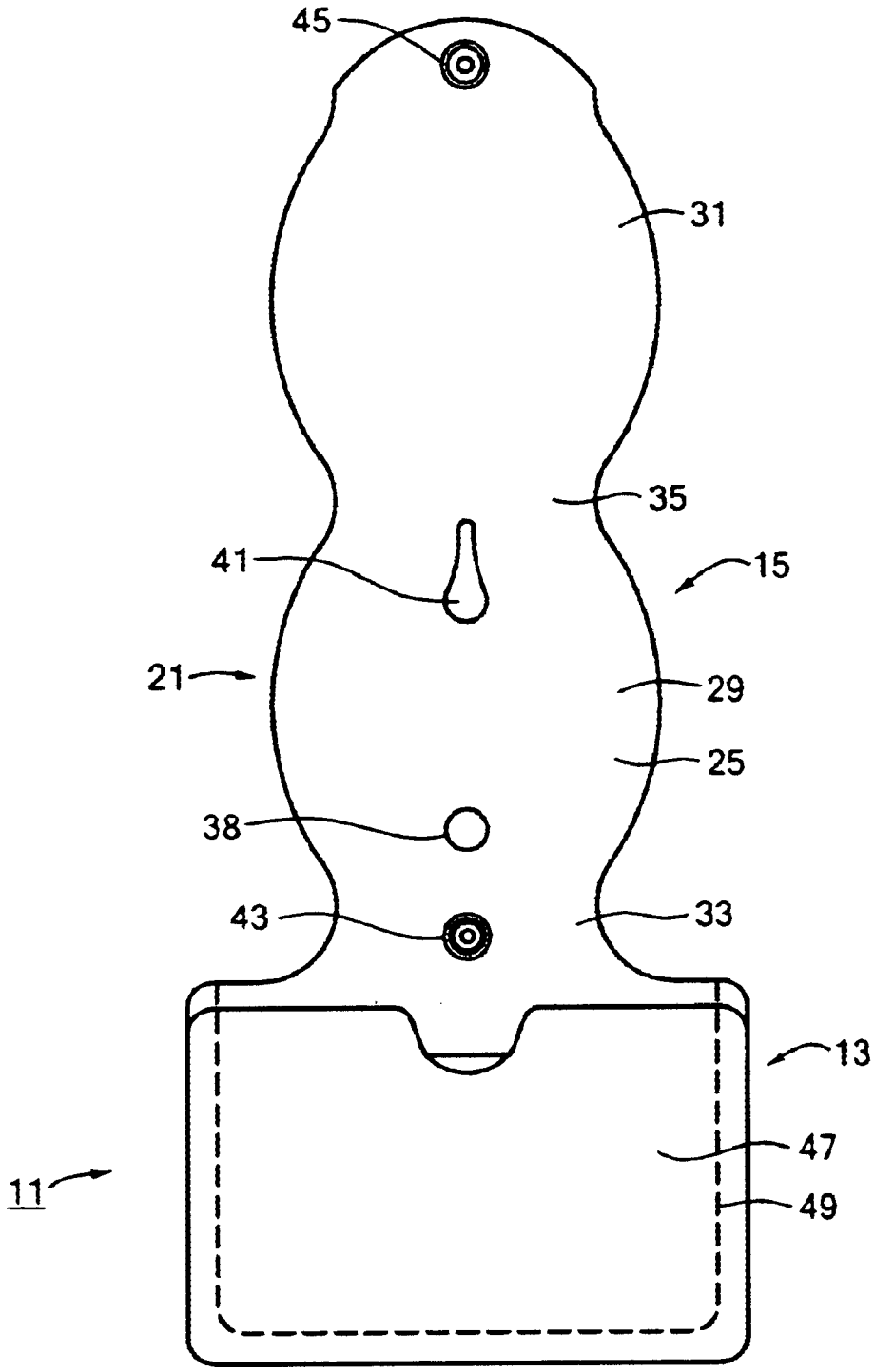
FIG. 2 is a rear plan view of the device shown in FIG. 1.
Figure 3:
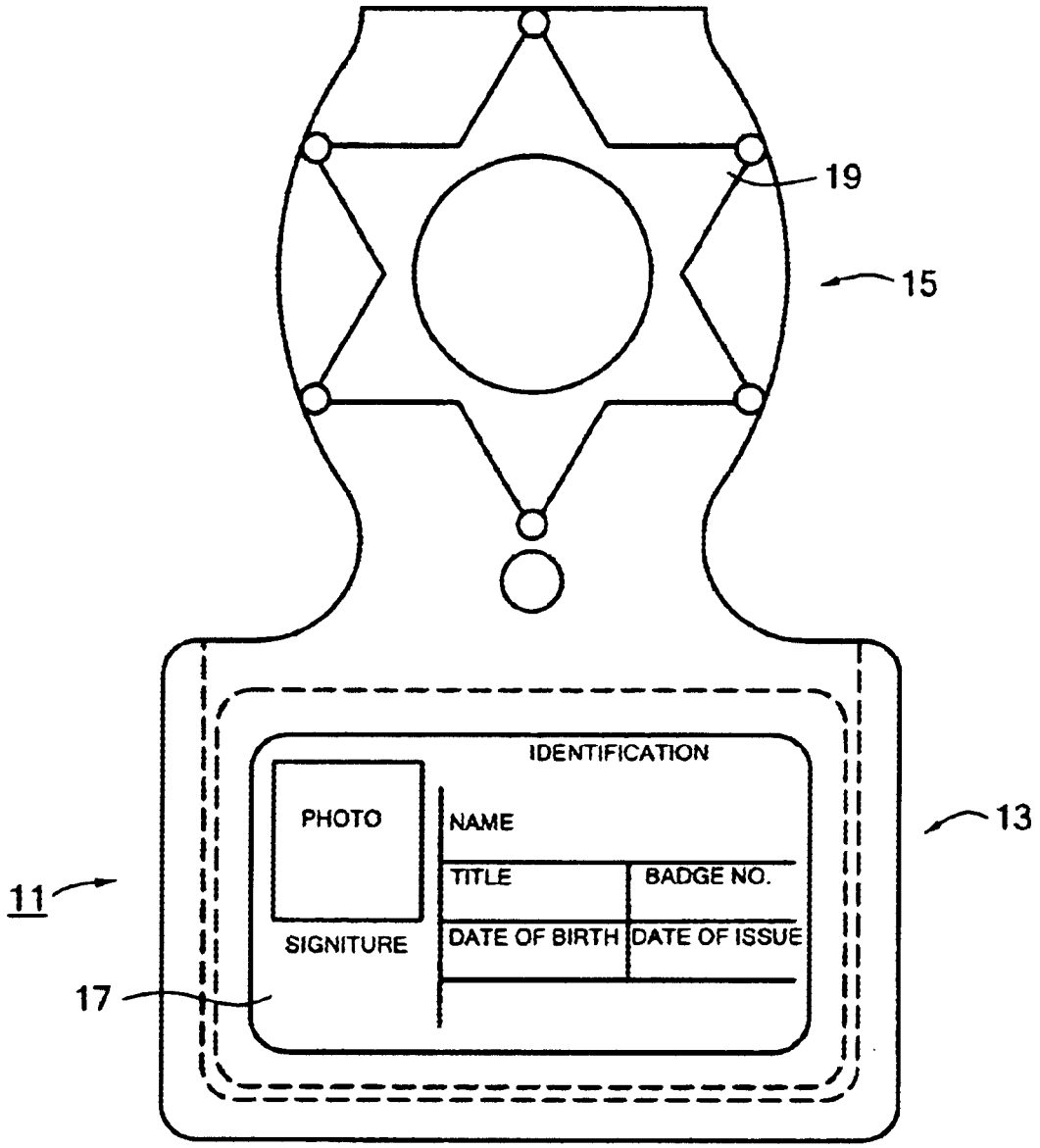
FIG. 3 is a front plan view of the device shown in FIG. 1, the device being shown formed into a closed loop, the device being shown with a badge and an identification card retained thereby.

As seen most clearly in FIGS. 1 and 2, device 11 comprises an elongated, flattened, unitary strip of material 21. For aesthetic and durability purposes, strip of material 21 is preferably manufactured out of a forty-five ounce leather which is either black in tan in color.

Strip of material 21 has an overall length L1 of approximately 9.75 inches and is shaped to include a front surface 23, a rear surface 25, an enlarged rectangular portion 27, a first enlarged oval portion 29 and a second enlarged oval portion 31. Enlarged rectangular portion 27 is connected to first enlarged oval portion 29 through a neck 33 of reduced width. Similarly, first enlarged oval portion 29 is connected to second enlarged oval portion 31 through a neck 35 of reduced width.

Enlarged rectangular portion 27 has a length L2 of approximately 2.75 inches and a width W1 of approximately 4.00 inches. A centered window 37 is cut out of portion 27. Window 37 is rectangular in shape and has a length L3 of approximately 1.75 inches and a width W2 of approximately 3.00 inches. As will be described further below, window 37 is sized and shaped so that the majority of identification card 17 can be aligned therewithin, thereby allowing identification card 17 to be shown in plain view. It should be noted that a transparent plastic cover (not shown) may be mounted onto rear surface 25 of portion 27 to protect ID card 17.

Enlarged oval portion 29 is sized and shaped to retain a badge 19 mounted thereon. Specifically, portion 29 is shaped to define a first opening 39 and a second opening 41. Second opening 41 is disposed directly above first opening 39 a distance D of approximately 1.56 inches. First opening 39 is disposed in close proximity to neck 33 and is generally circular in shape. Second opening 41 is disposed in close proximity to neck 35 and is generally key-holed in shape. Specifically, second opening 41 has a shape which is generally rounded, or circular, closest to first opening 39 and which tapers inward in a conical fashion away from first opening 39. As can be appreciated, the particular shape of second opening 41 enables device 11 to retain different sized badges, which is highly desirable.

A pair of complementary fasteners 43 and 45 are mounted onto opposite ends of second section 15. As will be described further below, second section 15 can be formed into a closed loop in such a manner so that fasteners 43 and 45 are coupled together, thereby securing second section 15 in its closed loop configuration. As can be appreciated, the ability of second section 15 to be releasably secured into a closed loop configuration enables device 11 to be easily removably coupled onto belt B, which is highly desirable.

As seen most clearly in FIG. 2, fastener 43 is in the form of a male snap fastener and is affixed to neck 33 in such a manner so that the male component of fastener 43 extends out from rear surface 25. Furthermore, fastener 45 is in the form of a female snap fastener and is affixed proximate to the free end of portion 31 in such a manner so that the female component of fastener 45 extends out from rear surface 25.

It should be noted that device 11 is not limited to the particular location of fasteners 43 and 45. Rather, it is to be understood that fasteners 43 and 45 could be affixed to any other portion of device 11 which allows device 11 to be releasably secured into a closed loop configuration without departing from the spirit of the present invention. For example, the location of fasteners 43 and 45 on strip of material 21 could be switched without departing from the spirit of the present invention.

It should also be noted that fasteners 43 and 45 need not be limited to complementary snap fasteners. Rather, it is to be understood that, without departing from the spirit of the present invention, alternate types of conventional complimentary fasteners (e.g., hook and pile type fasteners) could be used in place of fasteners 43 and 45 in order to retain device 11 in a closed loop configuration.

Figure 4:
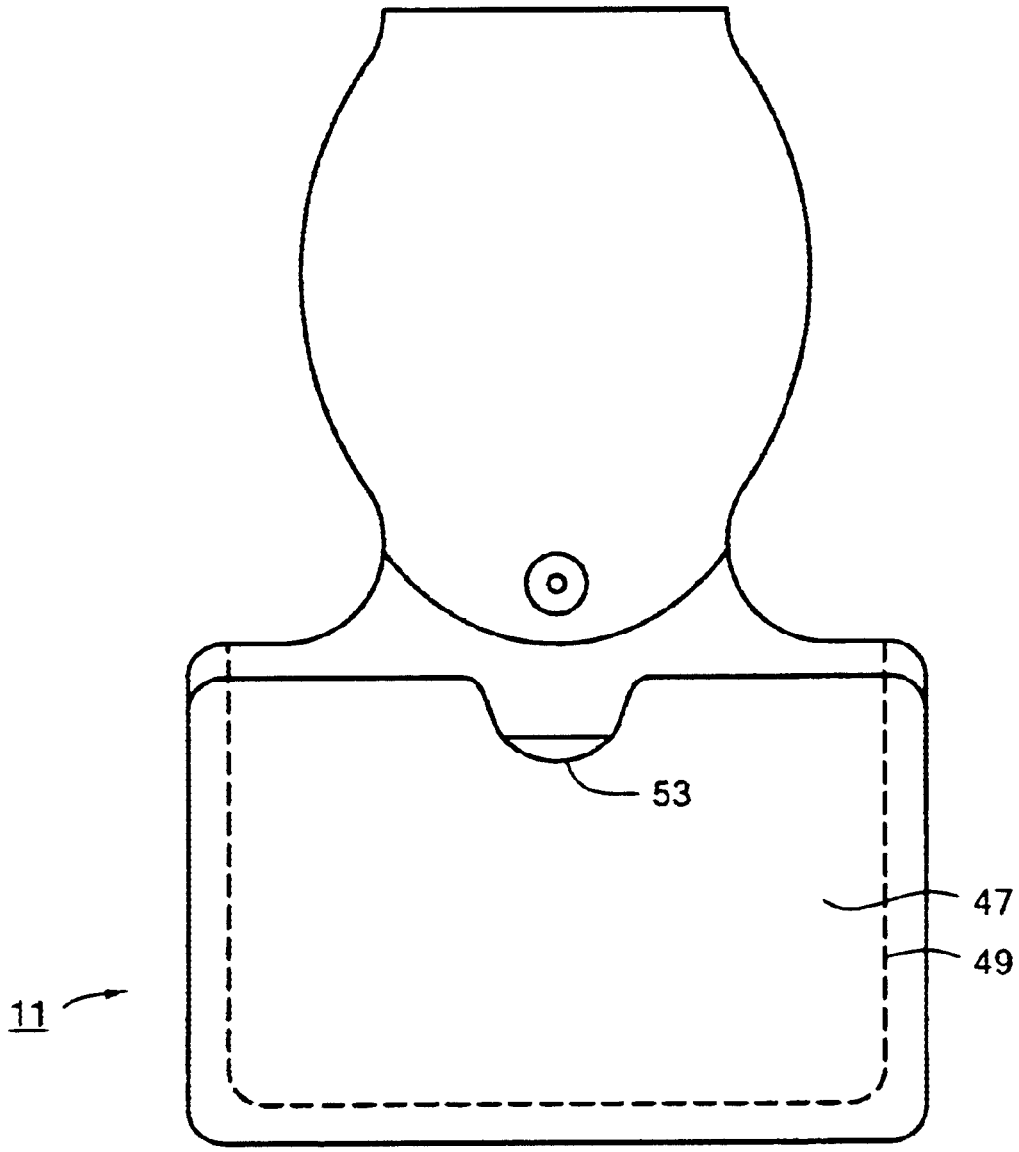
FIG. 4 is a rear plan view of the device shown in FIG. 1, the device being shown formed into a closed loop.
Figure 5:
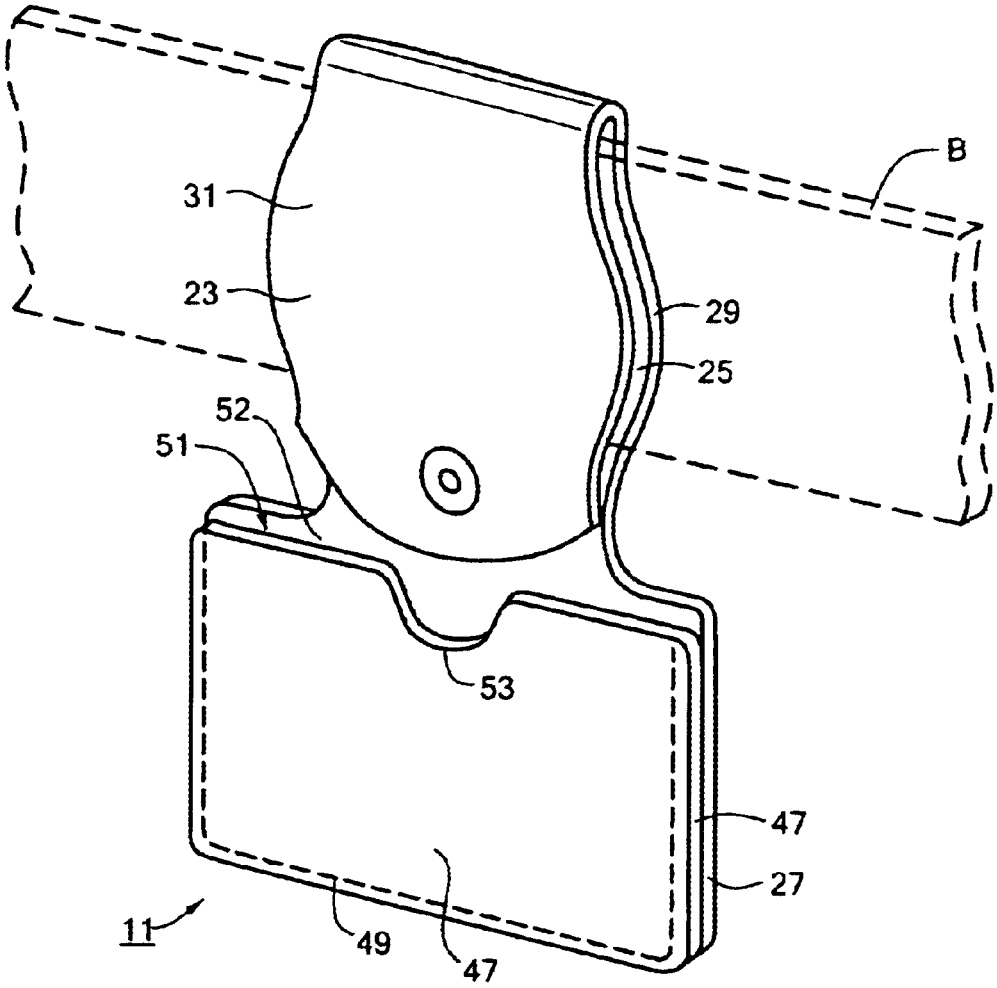
FIG. 5 is a rear perspective view of the device shown in FIG. 1, the device being shown formed into a closed loop and mounted onto a belt, said belt being shown in phantom.

As seen most clearly in FIGS. 2, 4 and 5, device 11 also comprises a shortened, flattened strip of material 47 which is preferably manufactured out of the same material as strip of material 21. Strip of material 47 is generally rectangular in shape and has approximately the length and width as portion 27 of strip of material 21.

During the process of manufacturing device 11, strip of material 47 is disposed against rear surface 25 of portion 27 so that the side and bottom edges of portion 27 lie flush with the side and bottom edges of strip of material 47. Disposed in this manner, strip of material 47 is permanently affixed onto portion 27 of strip of material 21 through sew line 49.

Sew line 49 preferably includes 3⁄16 inch stitches and serves to secure together strip of material 47 onto portion 27 of strip of material 21 along (or in close proximity to) three sides of its outer periphery. Specifically, sew line 49 secures strip of material 47 onto portion 27 of strip of material 21 along its bottom edge and along both of its side edges.

In this manner, strip of material 47 and strip of material 21 together partially define a pocket 51, as seen most clearly in FIG. 5. Pocket 51 is sized and shaped to fittingly receive identification card 17 with the majority of ID card 17 being aligned within window 37 for ease of viewing. It should be noted that strip of material 47 and portion 27 of strip of material 21 are not sewn together along one edge (namely, their top edges), thereby creating a slot 52 through which identification card 17 can be easily inserted into and removed from pocket 51. As can be appreciated, strip of material 21 is preferably shaped to include a rounded notch 53 along its top edge to facilitate the necessary separation between strip of material 47 and strip of material 21 at slot 52 in order insert/remove ID card 17 freely into/from pocket 51.

In use, device 11 may be used in the following manner to hold both a badge 19 and an identification card 17 and, at the same time, be mounted onto the belt of an officer, thereby displaying badge 19 and identification card 17 in plain view of others, which is a principal object of the present invention.

In order to retain badge 19 onto device 11, the rear surface of badge 19 is drawn against front surface 23 of portion 29. As badge 19 is drawn towards portion 29, the elongated sharpened pin (not shown) affixed onto the rear surface of badge 19 is disposed through opening 41. Similarly, as badge 19 is drawn towards portion 29, the clasp (not shown) affixed onto the rear surface of badge 19 projects through opening 39. With the elongated sharpened pin and the clasp disposed through openings 41 and 39, respectively, the rear surface of badge 19 is disposed in contact against front surface 23 of portion 29. While maintaining badge 19 in place on front surface 23 of portion 29, the elongated sharpened pin is pivoted downward and into engagement with the clasp, thereby securing badge 19 in place on portion 29 of device 11.

In order to retain identification card 17 onto device 11, the user preferably grasps rounded notch 53 and pulls strip of material 47 away from strip of material 21, thereby opening up slot 52. With slot 52 opened in this manner, identification card 17 is disposed through slot 52 and into pocket 51 so that the front surface of identification card 17 is displayed through window 37, as seen most clearly in FIG. 3. With ID card 17 properly disposed within pocket 51, the user releases notch 53 which, in turn, causes strip of material 47 to resiliently return to its original position in abutment against strip of material 21, thereby securing ID card 17 in place within pocket 51.

With badge 19 and identification card 17 secured onto device 11 as described above, device 11 can be easily mounted onto belt B in the following manner. Specifically, second section 15 is folded about neck 35 so that rear surface 25 of portion 31 is drawn towards rear surface 25 of portion 29, as seen most clearly in FIG. 5. With second section 15 folded about neck 35, device 11 is slid down onto belt B of the officer with portion 31 disposed behind belt B of the officer and portion 29 disposed in front of belt B of the officer. With device 11 slid down until neck 35 abuts against the top surface of belt B, fastener 45 is drawn towards fastener 43. Drawing fasteners 43 and 45 together creates a snap-fit engagement which, in turn, secures second section 15 in a closed loop configuration around belt B of the officer with badge 19 and ID card 17 facing forward in plain view of others. As can be appreciated, device 11 can be easily removed from belt B of the officer by disengaging fastener 45 from 43 and sliding device 11 off of belt B of the officer.

Figure 6:
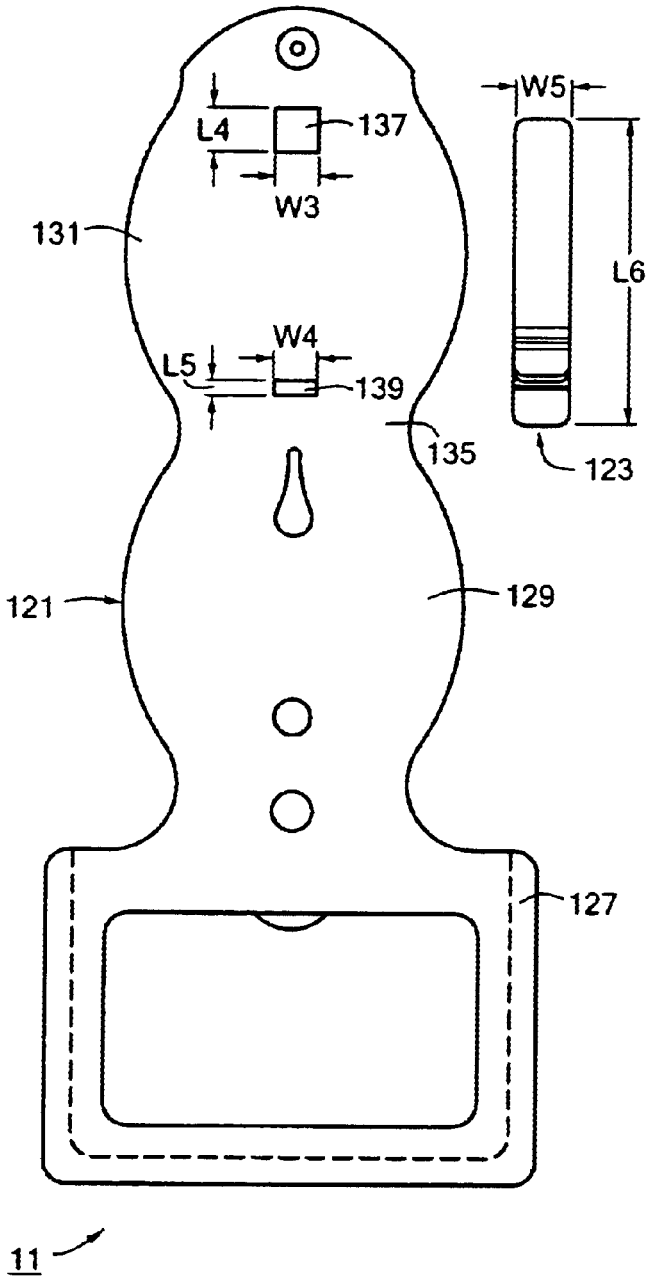
FIG. 6 is a front plan view of a second embodiment of a device for holding a badge and an identification card.

Referring now to FIG. 6, there is shown a second embodiment of a device for holding a badge and an identification card, the device being constructed according to the teachings of the present invention and identified generally by reference numeral 101.

Device 101 differs from device 11 in two principal ways. First, device 101 comprises a strip of material 121 which differs slightly in shape from strip of material 21. Second, device 101 additionally comprises a conventional spring clip 123.

With regard to the first difference, strip of material 121 is shaped to include an enlarged rectangular portion 127, a first enlarged oval portion 129, a second enlarged oval portion 131, a neck 133 of reduced width for connecting portion 127 to portion 129, and a neck 135 of reduced width for connection portion 129 to portion 131. Strip of material 121 differs from strip of material 21 only in that portion 131 of strip of material 121 is shaped to include a first opening 137 and a second opening 139, first opening 137 being disposed directly above second opening 139. First opening 137 is square shaped and has a length L4 of approximately ⅜ of an inch and a width W3 of approximately ⅜ of an inch. Second opening 139 is rectangular in shape and has a length L5 of approximately ⅛ of an inch and a width W4 of approximately ⅜ of an inch. It should be noted that together openings 137 and 139 serve to retain spring clip 123 mounted onto portion 131 of device 101, as will be described further below.

Figure 7A:
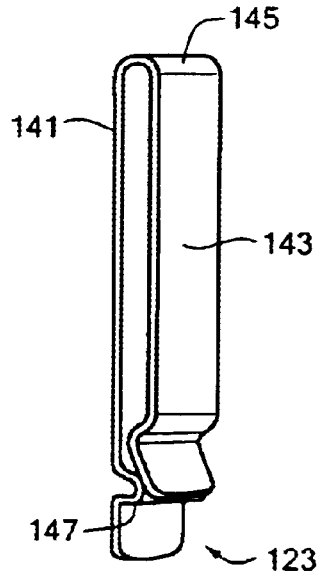
FIG. 7(*a*) is a front perspective view of the fastener shown in FIG. 6.
Figure 7B:
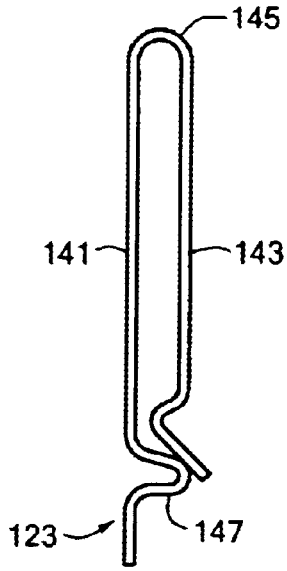

With regard to the second difference, spring clip 123 is conventional in construction and has a length L6 of approximately 2.56 inches and a width W5 of approximately ⅜ of an inch. As seen most clearly in FIG. 7(*a*) and FIG. 7(*b*), spring clip 123 comprises a front arm 141 and a rear arm 143 which are connected together through a bend 145, thereby rendering spring clip 123 a unitary device. Upon the application of a significant separation force, front arm 141 can be urged away from rear arm 143. Once the separation force is removed, front arm 141 resiliently pivots back towards rear arm 143 until front arm 141 contacts a bend 147 formed in rear arm 143.

Spring clip 123 is preferably mounted onto portion 131 of device 101 in such a manner so that front arm 141 and rear arm 143 are disposed on opposite surfaces of portion 131. Specifically, spring clip 123 is mounted onto portion 131 so that front arm 141 is disposed against the front surface of portion 131 and rear arm 143 is disposed against the rear surface of portion 131, with bend 145 projecting through opening 137 and bend 147 projecting through opening 139. In this capacity, spring clip 123 serves as an additional means for releasably securing device 101 onto the belt of an officer, which is highly desirable.

The embodiments shown of the present invention are intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A device for holding a badge and an identification card for simultaneous viewing thereof and which is adapted to be removably mounted on a belt of a person, said badge having a pin and a clasp, said device comprising:

(a) an elongated unitary strip of material having a front surface and a rear surface, said elongated unitary strip of material including a first rectangular portion having a centered window, a first oval portion, a first neck portion connecting the first rectangular portion to the first oval portion, a second oval portion and a second neck portion connecting the second oval portion to the first oval portion, (b) a generally rectangular strip of material having a top edge, a bottom edge and two side edges, said generally rectangular strip being disposed against the rear surface of the first rectangular portion and being permanently secured to first rectangular portion by a sew line along its bottom edge and its two side edges thereof to define a pocket open along its top edge and into which may be inserted the identification card, (c) a first pair of openings for use in attaching said badge to said device, said first pair of openings being in said first oval portion, one of said openings being for receiving the pin of said badge and the other one of said openings being for receiving the clasp of said badge, and (d) a pair of complementary fasteners, one of said pair of complementary fasteners being mounted on said first neck portion and extending out rearwardly from said rear surface of said front neck portion and the other one of said pair of complementary fasteners being mounted on the second oval portion and extending out rearwardly from said rear surface of said second oval portion, (e) whereby said second oval portion can be folded over about said second neck portion to said first oval portion and said pair of complementary fasteners coupled together to form a closed loop for use in mounting the device onto the belt of the user.

2. The device of claim 1 wherein said device further includes a spring clip removably mounted on said second oval portion for use in releasably securing said device onto said belt of said person.

3. The device of claim 2 wherein said elongated unitary strip of material and said generally rectangular strip of material are both made of leather, said generally rectangular strip of material has approximately the same length and width as the first rectangular portion of said elongated strip of material, said centered window on said first rectangular portion is rectangular in shape, said other opening in said first pair of openings is in close proximity to said second neck portion in said elongated unitary strip of material and is generally key-holed in shape, said one opening in said first pair of openings is circular in shape and is below said other opening, said complementary fasteners are snap fasteners and said second oval portion in said elongated unitary strip of material includes a second pair of openings for use in attaching thereto said spring clip.

* * * * *